US005149245A

United States Patent [19]

Landmann

[11] Patent Number: 5,149,245

[45] Date of Patent: Sep. 22, 1992

[54] BALL RETRIEVER

[76] Inventor: Howard Landmann, 16637 Valley Dr., Tampa, Fla. 33618

[21] Appl. No.: 590,674

[22] Filed: Oct. 1, 1990

[51] Int. Cl.[5] ..... B60P 1/00

[52] U.S. Cl. ..... 414/440; 56/328.1

[58] Field of Search ..... 414/434, 435, 437, 439–443; 56/328.1

[56] References Cited

U.S. PATENT DOCUMENTS

| | | | |
|---|---|---|---|
| 2,652,678 | 9/1953 | Ramacher | 56/328.1 |
| 2,658,637 | 11/1953 | Bailey | 414/440 |
| 2,792,955 | 5/1957 | Sumner | 414/440 |
| 3,102,647 | 9/1963 | Bonney | 414/440 |
| 3,856,165 | 12/1974 | Gustafson et al. | 414/440 |
| 3,863,430 | 2/1975 | Jennings | 414/437 X |
| 3,888,370 | 6/1975 | Gamblin | 414/440 |
| 3,995,759 | 12/1976 | Hollrock et al. | 414/440 |
| 4,157,141 | 6/1979 | Ryan | 414/440 |
| 4,158,418 | 6/1979 | Hayashi | 414/440 |
| 4,252,490 | 2/1981 | Keller | 56/328.1 X |
| 4,721,428 | 1/1988 | Rohrer et al. | 414/439 |
| 4,782,654 | 11/1988 | Bezzerides | 56/328.1 X |
| 4,792,271 | 12/1988 | Akel | 414/440 |

FOREIGN PATENT DOCUMENTS

| | | | |
|---|---|---|---|
| 978372 | 11/1975 | Canada | 414/439 |
| 2443851 | 8/1980 | France | 414/434 |
| 2555455 | 5/1985 | France | 414/439 |
| 891014 | 12/1981 | U.S.S.R. | 56/328.1 |

*Primary Examiner*—David A. Bucci

*Attorney, Agent, or Firm*—Frijouf, Rust & Pyle

[57] ABSTRACT

An apparatus is disclosed for retrieving balls and depositing the balls into a container. The apparatus comprises a frame for moving over the ground by a separate motor vehicle. A plurality of rake heads are mounted to the frame for sliding over the surface of the ground and directing the balls toward a ball catcher. Each of the rake heads is positioned at an angle with the direction of forward motion of the apparatus such that a ball which contacts one of the rake heads is directed toward the ball catcher. The ball catcher picks up the balls from the ground and transports the balls to the container.

11 Claims, 10 Drawing Sheets

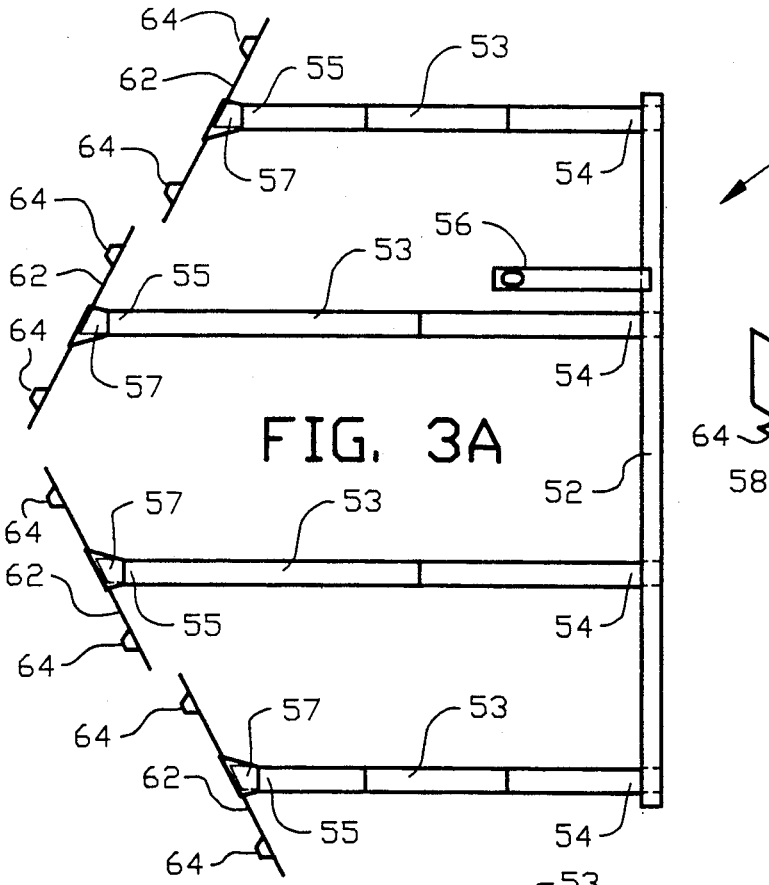
FIG. 3A
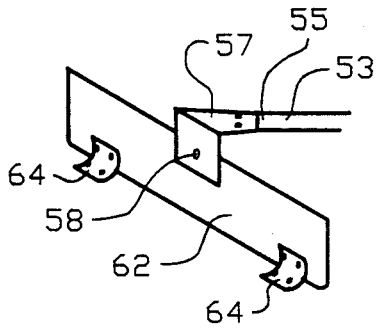
FIG. 3C
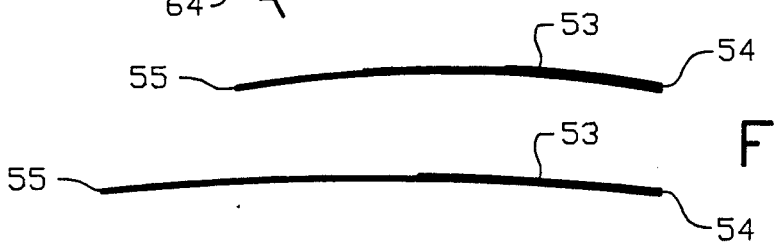
FIG. 3B
FIG. 3D
FIG. 3E
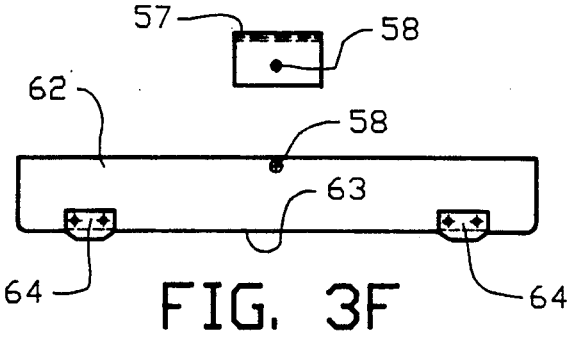
FIG. 3F
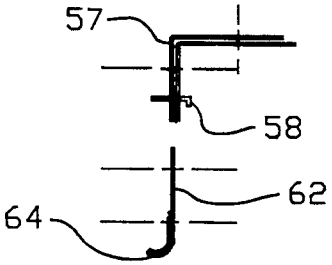
FIG. 3G

BALL RETRIEVER

BACKGROUND OF THE INVENTION

1. Field Of The Invention

This invention relates to a device for picking up loose articles on the ground, and specifically for retrieving balls scattered over a wide area such as a golf ball driving range.

2. Information Disclosure Statement

In the golf industry, it is desirable to utilize a device which can retrieve balls which are scattered over a wide area of ground, as would be found at a golf driving range. This avoids the costly and time consuming method of retrieving balls manually. Such a device should be efficient, reliable, and economical to operate.

The prior art discloses several inventions in this area. U.S. Pat. No. 3,888,370 to Gambiin (1975) discloses a device in which golf balls indiscriminately distributed over the surface of a driving range are retrieved by arcuate upward displacement into a receptacle, being retrieved by an arcuately discontinuous transfer means moving in entrained relation to pick up the ball.

U.S. Pat. No. 3,995,759 to Hollrock et al. (1976) shows a golf ball retriever having a picker roll having a plurality of thin discs spaced one from the other along a common central axis by a uniform spacing slightly less than the diameter of a golf ball. The picker roll is readily removable from a supporting frame and, after such removal, the discs making up the roll may be successively disassembled from either end thereof to reach and remove a damaged or broken disc when repairing the roll.

U.S. Pat. No. 4,157,141 to Ryan (1979) shows an open bottomed wheeled carriage having upstanding side plates between which a flexible mat is dragged over the ground. The front end only of the mat is secured to a cross bar on the carriage at a height greater than the height of a golf ball on the ground. The mat is made up of pivotally joined rings, links or parallel chains so that balls on the ground over which the mat is pulled will pass upwardly through the rings, between the links or chains to the upper surface of the mat. A cleated endless belt, driven by the carriage supporting ground wheels, sweeps the balls rearwardly over the mat into a container on the rear of the carriage.

U.S. Pat. No. 4,158,148 to Hayashi (1979) discloses an improved golf ball collector, which comprises a plurality of ball catching wheels on a common axle which wheels are parallel with and spaced from each other so that the distance between two adjacent wheels is slightly smaller than the diameter of golf balls. In front of each of the wheels is arranged one disk wheel which is aligned therewith and which is slightly elevated off the ground and is rotated in the reverse direction relative to the direction of rotation of the ball catching wheels. Means is provided to deliver balls from the ball catching wheels to a container.

Each of these devices disclosed in the prior art, however, suffers from certain shortcomings. Some are of complicated design, and therefore more difficult and expensive to build and maintain, and less reliable to operate. Some are inefficient in that the devices can be operated only at relatively slow speeds, or the width of the swath of ground covered with each pass is restricted to the width of the ball collecting mechanism. Moreover, some devices fail to collect a very high percentage of the balls covered, thus requiring multiple passes over the same ground, and thereby further diminishing efficiency. If the ground is soft, some devices may press below ground level the balls which are not collected, making the balls difficult to collect later manually, or causing the balls to be lost altogether. Lastly, the devices disclosed in the prior art are not flexible, that is each device uses the same means for all terrains and all conditions.

Therefore, it is an object of the present invention to provide an improved device for retrieving balls which is simple in design and reliable in operation.

Another object of this invention is to provide an improved device for retrieving balls which is inexpensive to operate and maintain.

Another object of this invention is to provide an improved device for retrieving balls which provides more efficient operation through higher speeds, a wider swath, and an increased percentage of balls retrieved.

Another object of this invention is to provide an improved device for retrieving balls which is flexible, in that the device can be adapted for different terrain and ground conditions.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method and apparatus for retrieving balls and depositing the balls into a container. The device comprises a frame which is capable of being moved over the ground, and which is propelled by motive means which is typically a separate motor vehicle. A rake assembly is mounted under the frame, and comprises a plurality of rake heads in contact with the ground for sliding over the surface of the ground and directing the balls toward ball catching means. The rake heads are removably mounted, and each is positioned at an angle with the direction of forward motion of the apparatus such that a ball which contacts one of the rake heads is directed toward the ball catching means. The ball catching means is mounted preferably on the frame for picking up the balls from the ground, and for transporting the balls to the container. The container may rest on the frame, or on a separate vehicle.

In a more specific embodiment of the invention, the ball catching means is a vertical wheel which is mounted on the rear of the frame, and which rotates in the vertical plane, parallel to the direction of travel of the apparatus. The rotation of the vertical wheel is powered by friction with the ground when the motor vehicle propels the apparatus over the ground. A slot is located in the perimeter of the vertical wheel, and is lined with a resilient lining such as foam rubber or other like resilient material for picking up the balls from the ground in the slot. A descending tube is mounted on the frame extending from the vertical wheel to the container mounted preferably on the rear of the frame. The vertical wheel transports the balls from the ground to the descending tube. A ball dislodging finger mounted on the descending tube dislodges the balls from the slot in the vertical wheel and causes the balls to enter the descending tube. The balls then roll downhill through and out of the descending tube, dropping into the container.

In another embodiment of the invention, a pickup chute is mounted on one of the plurality of rake heads for receiving balls. The ball catching means is a horizontal wheel which is mounted adjacent to the pickup chute, and which rotates preferably in the horizontal plane, but which may also be positioned vertically. A power source, typically an electric motor, drives the horizontal wheel. A plurality of paddles are attached to the perimeter of the horizontal wheel for sweeping the balls into the pickup chute. An ascending tube is mounted on the pickup chute extending from the pickup chute to the container. The paddles drive the balls from the pickup chute, through the ascending tube, and into the container.

In still another embodiments of the invention, the rake heads are held in tension against the ground by a plurality of adjustable springs. Disengagement means is mounted on the frame for lifting the rake heads from and lowering the rake heads to the ground. A plurality of brackets are mounted on the frame for attaching several apparatuses together in a side-by-side fashion.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 3A is a top view of a rake assembly;

FIG. 3B is a side view of adjustable springs for the rake assembly;

FIG. 3C is an isometric view of a rake head bracket and a rake head of the rake assembly;

FIG. 3D is a front view of the rake head bracket;

FIG. 3E is a side view of FIG. 3D;

FIG. 3F is a front view of a first type of the rake head which is flat;

FIG. 3G is a side view of FIG. 3F;

Similar reference characters refer to similar parts throughout the several Figures of the drawings.

DETAILED DISCUSSION

Figure 1:
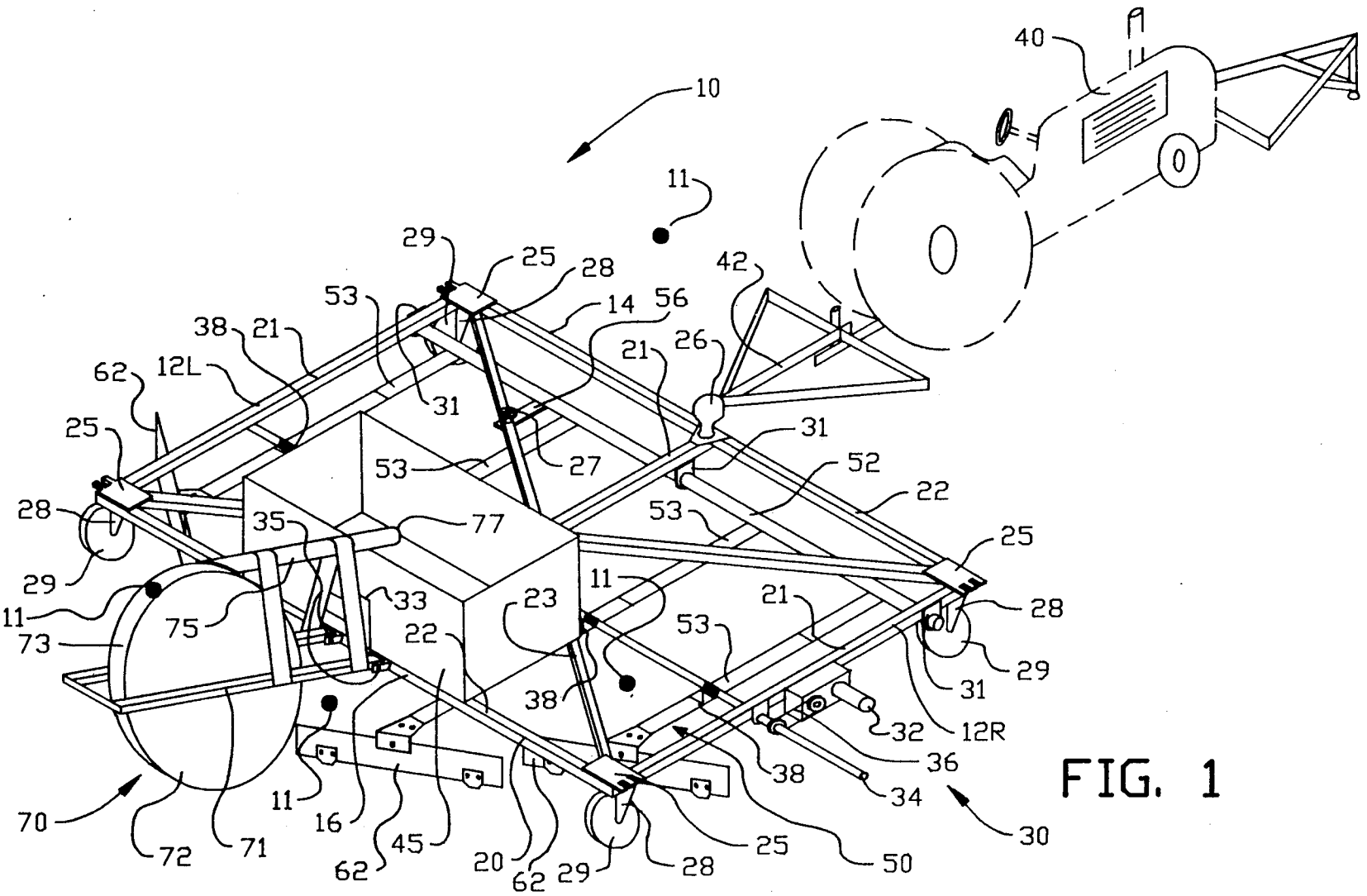
FIG. 1 is an isometric view of the preferred embodiment of an apparatus for retrieving ball having the vertical wheel assembly.

FIG. 1 is an isometric view of a ball retrieval apparatus, shown generally as 10, for retrieving balls 11 and depositing the balls 11 into a container 45. The retrieval apparatus 10 comprises a frame 20, motive means shown as a tractor 40, a rake assembly 50, and ball catching means 70. In this embodiment, the ball catching means 70 is shown as a vertical wheel assembly.

Figure 2A:
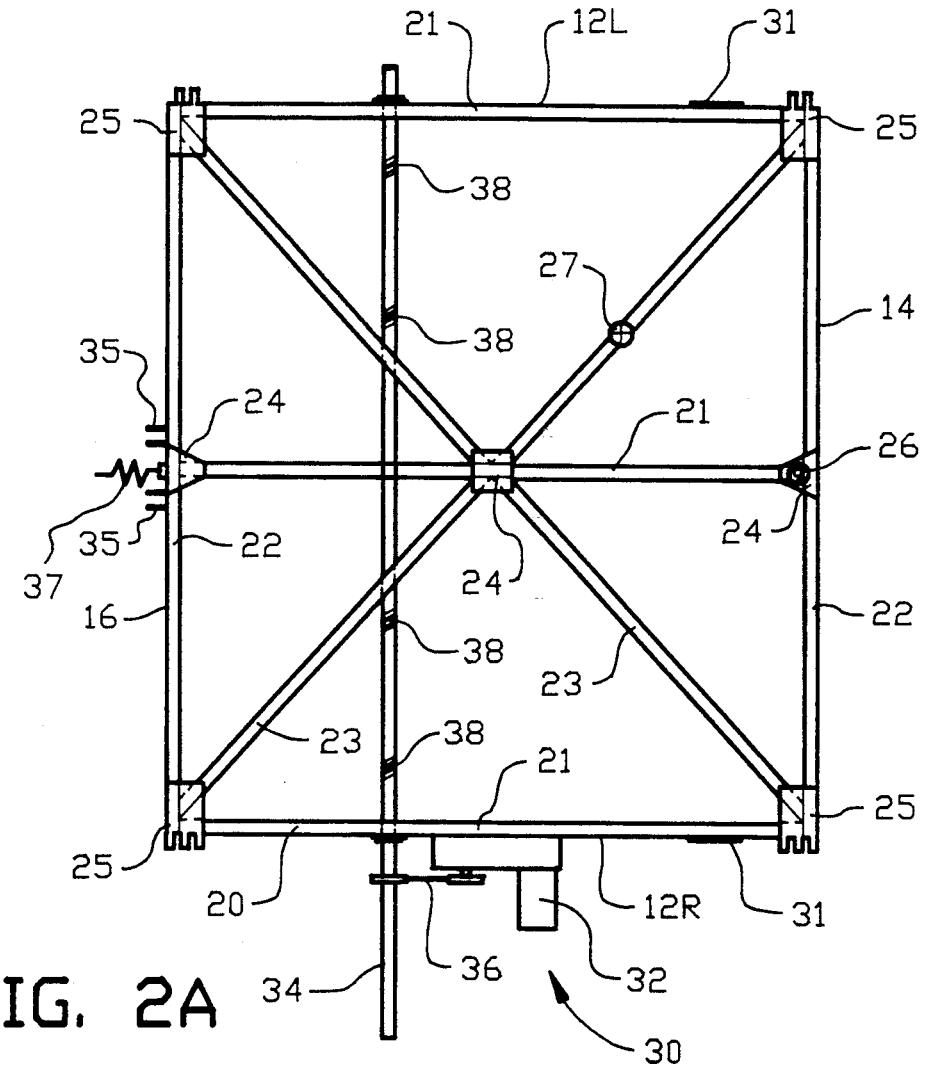
FIG. 2A is a top view of a frame of the apparatus.
Figure 2C:
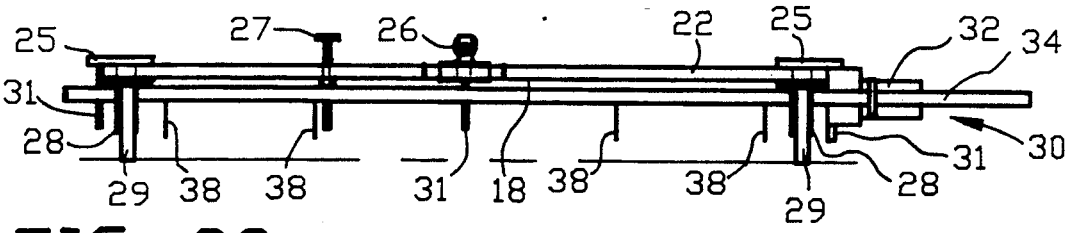
FIG. 2C is a rear view of FIG. 2A.
Figure 2B:
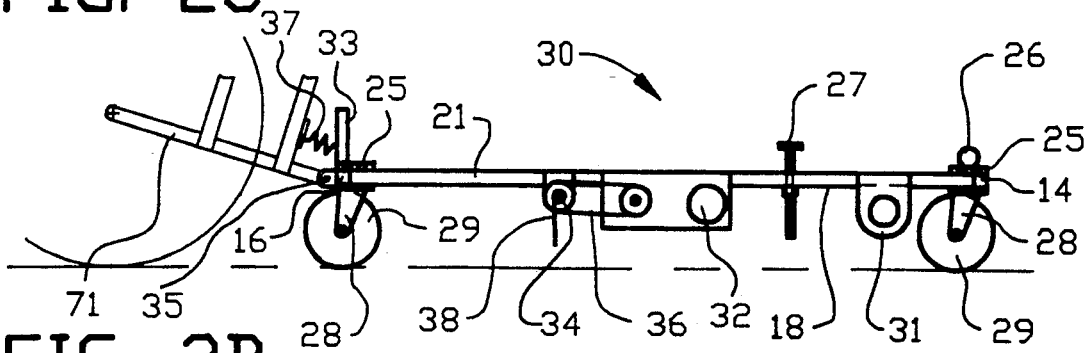
FIG. 2B is a side view of FIG. 2A.

As shown in FIG. 1, and in greater detail in FIGS. 2A–C, the frame 20 of the retrieval apparatus 10 comprises a plurality of longitudinal beams 21, a plurality of lateral beams 22, and a plurality of diagonal beams 23, all mounted in the horizontal plane. The plurality of longitudinal beams 21 extend from a forward end 14 of the frame 20 to a rear end 16 of the frame 20. The plurality of lateral beams 22 extend from a right side 12R of the frame 20 to a left side 12L of the frame 20, and are perpendicular to the plurality of longitudinal beams 21. The plurality of diagonal beams 23 are mounted diagonally to the plurality of longitudinal beams 21 and the plurality of lateral beams 22. A plurality of gusset plates 24 are affixed to each of the plurality of beams for forming a junction of each of the plurality of beams 21 and 23.

A plurality of brackets 25 are mounted on the right side 12R and the left side 12L of the frame 20. A hitch 26 is mounted on the forward end 14 of the frame 20. The container 45 is mounted on the rear end 16 of the frame 20. A plurality of axle brackets 31 are mounted on an underside 18 of the forward end 14 of the frame 20. An adjustable locking screw 27 is also mounted on the frame 20.

As shown in FIG. 1, and in greater detail in FIGS. 2B and 2C, a plurality of swivels 28 are secured on the underside 18 of the frame 20 for rotationally mounting a plurality of wheels 29 to support the frame 20 above the ground.

A disengagement assembly 30 is also mounted on the frame 20. The disengagement assembly 30 comprises a disengagement power source shown as a motor 32, a disengagement axle 34, a motor-axle linkage 36 for linking the motor 32 to the disengagement axle 34, and an axle-rake linkage 38. The disengagement power source may be electrically powered, such as the motor 32, or manually powered such as a crank (not shown) or similar device.

Motive means shown as the tractor 40 in FIG. 1 is a motor vehicle which is independent of the apparatus 10, and which has sufficient power to propel the apparatus 10 over the ground. The tractor 40 is attached to the hitch 26 through connecting means shown as a push-/pull bar 42. The connecting means may be rigid as shown, or may be flexible, such as a plurality of cables (not shown) or the like.

FIG. 1 depicts the rake assembly 50 mounted on the underside 18 of the frame 20. As shown in FIG. 1 and in greater detail in FIGS. 3A and 3B, the rake assembly 50 comprises a spring means, shown as a plurality of adjustable springs 53, and a plurality of rake heads 62. Each of the plurality of adjustable springs 53 has a mounting end 54 and a rake end 55. An axle 52 is mounted horizontally on the plurality of axle brackets 31, as shown in FIG. 1, and is rotatable about the axis of the axle 52. Each of the plurality of adjustable springs 53 is affixed at the mounting end 54 to the axle 52, through welding, bolting, or other like means. Spring adjustment means shown as a tension lever 56 is also mounted on axle 52, and contacts the adjustable locking screw 27, shown in FIGS. 1 and 2A–C. Each of the plurality of adjustable springs 53 is linked to the disengagement axle 34 through the axle-spring linkage 38, shown in FIG. 1. As shown in FIG. 3C, one of a plurality of rake head brackets 57 is mounted on the rake end 55 of each of the plurality of adjustable springs 53.

Figure 4A:
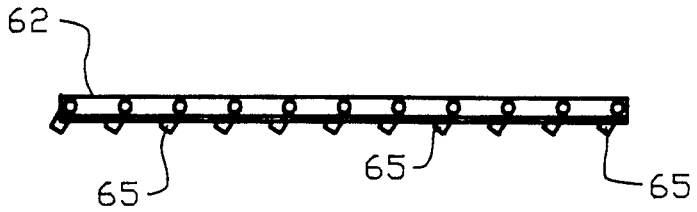
FIG. 4A is a top view of a second type of the rake head which has tines oriented for right side mounting.
Figure 4B:
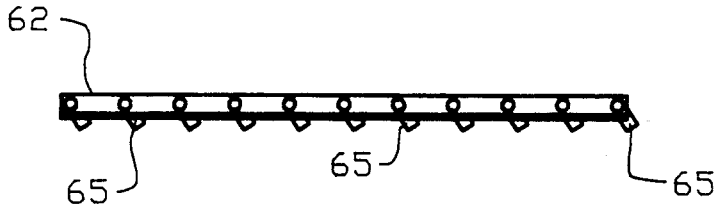
FIG. 4B is a top view of the second type of the rake head which has tines oriented for left side mounting.
Figure 4C:
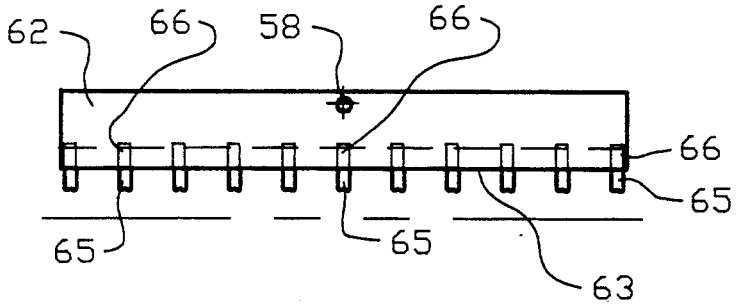
FIG. 4C is a front view of FIG. 4A.
Figure 4D:
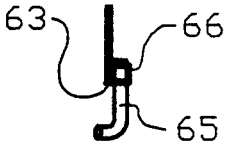
FIG. 4D is a side view of FIG. 4A.

As shown in FIGS. 3A and 3C–F, each of the plurality of rake heads 62 is removably mounted to one of the adjustable springs 53 on one of the plurality of rake head brackets 57 by a rake head mounting pin 58, and is positioned in contact with the ground at an angle with the direction of motion of the apparatus 10. Each of the plurality of rake heads 62 is flat on a ground end 63. A plurality of plates 64 are attached to the ground end 63 of each of the plurality of rake heads 62. Each of the plurality of plates 64 contacts the ground and is bent rearward. FIGS. 4A–D depict another type of rake head, in which each of the plurality of rake heads 62 comprises a plurality of tines 65 mounted to the ground end 63 through a plurality of tine brackets 66. Each of the plurality of tines 65 is also bent rearward. Each of the plurality of rake heads 62 shown in FIG. 4A is for mounting on the right side 12R and in FIG. 4B for mounting on left side 12L of the frame 20.

Figure 5A:
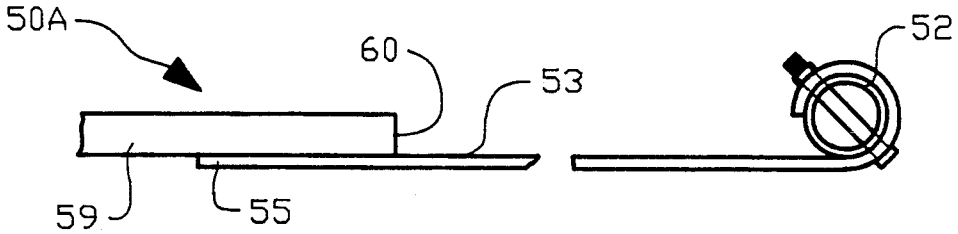
FIG. 5A is a side view of a third type of the spring and the rake handle.
Figure 5B:
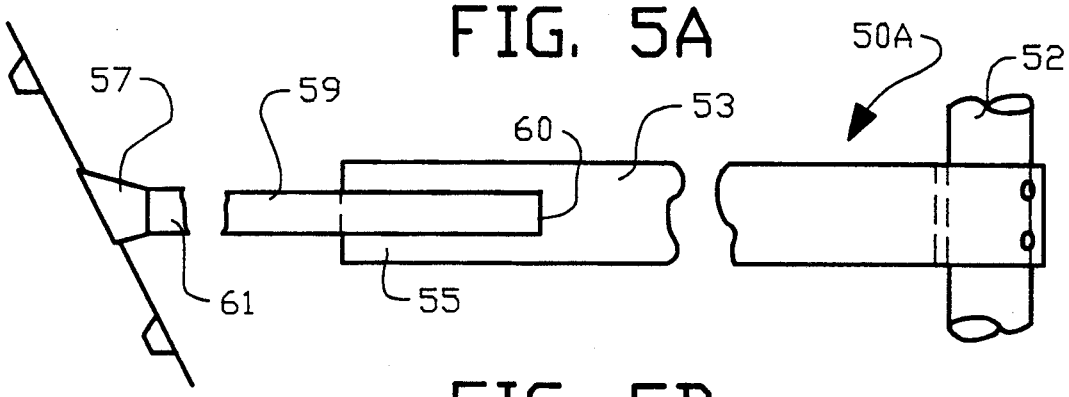
FIG. 5B is a top view of FIG. 5;.

FIGS. 5A and 5B show a second type of the rake assembly 50A in which one of the plurality of rake head brackets 57 is not mounted directly on each of the plurality of adjustable springs 53. One of a plurality of rake handles 59, having a first end 60 and a second end 61, is mounted on the rake end 55 of each of the plurality of adjustable springs 53 at the first end 60 of one of the plurality of rake handles 59. One of the plurality of rake head brackets 57 is mounted on the second end 61 of each of the plurality of rake handles 59.

Figure 6A:
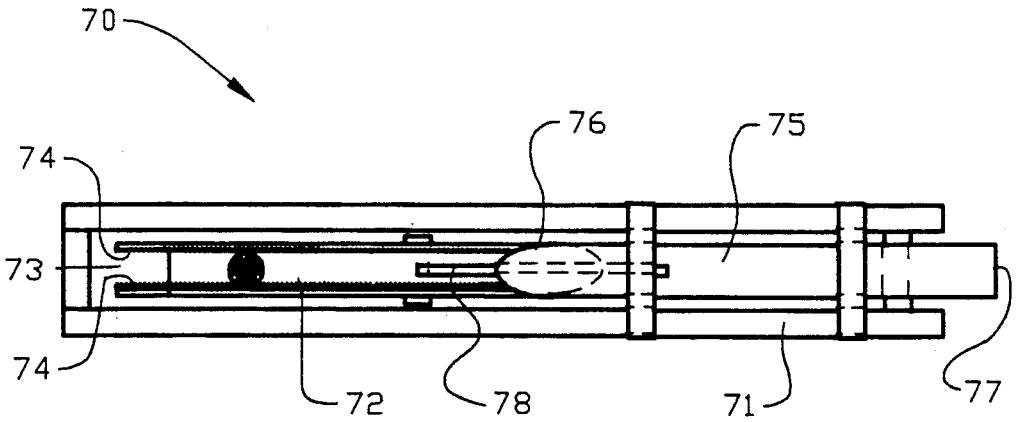
FIG. 6A is a top view of the vertical wheel assembly.
Figure 6B:
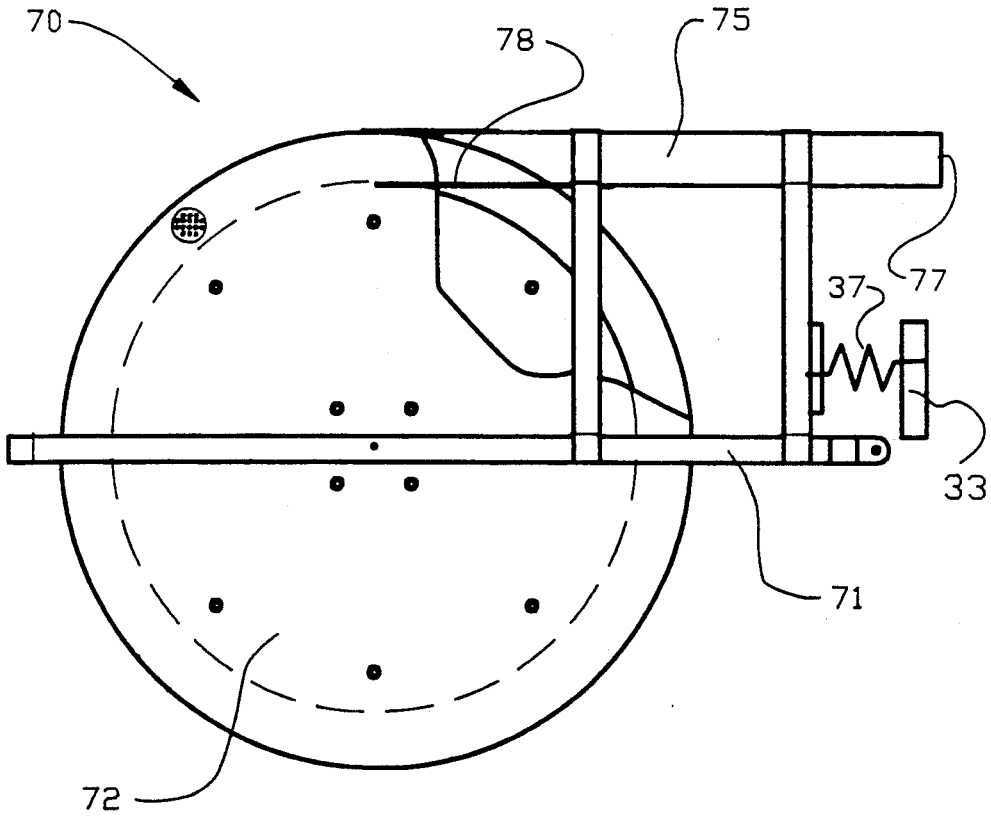
FIG. 6B is a side view of the vertical wheel assembly.
Figure 7A:
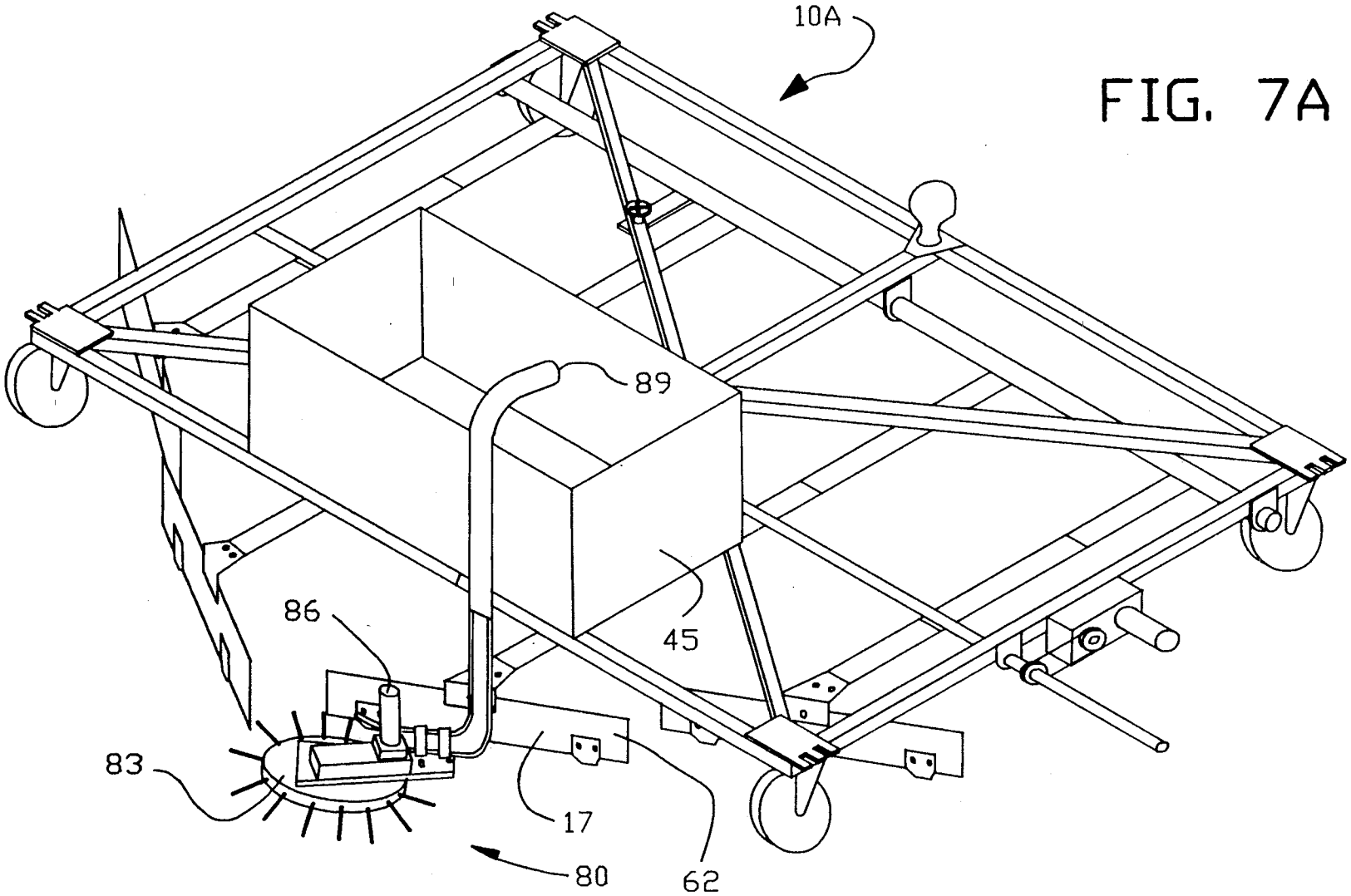
FIG. 7A is an isometric view of a second embodiment of the apparatus having the horizontal wheel assembly.
Figure 7B:
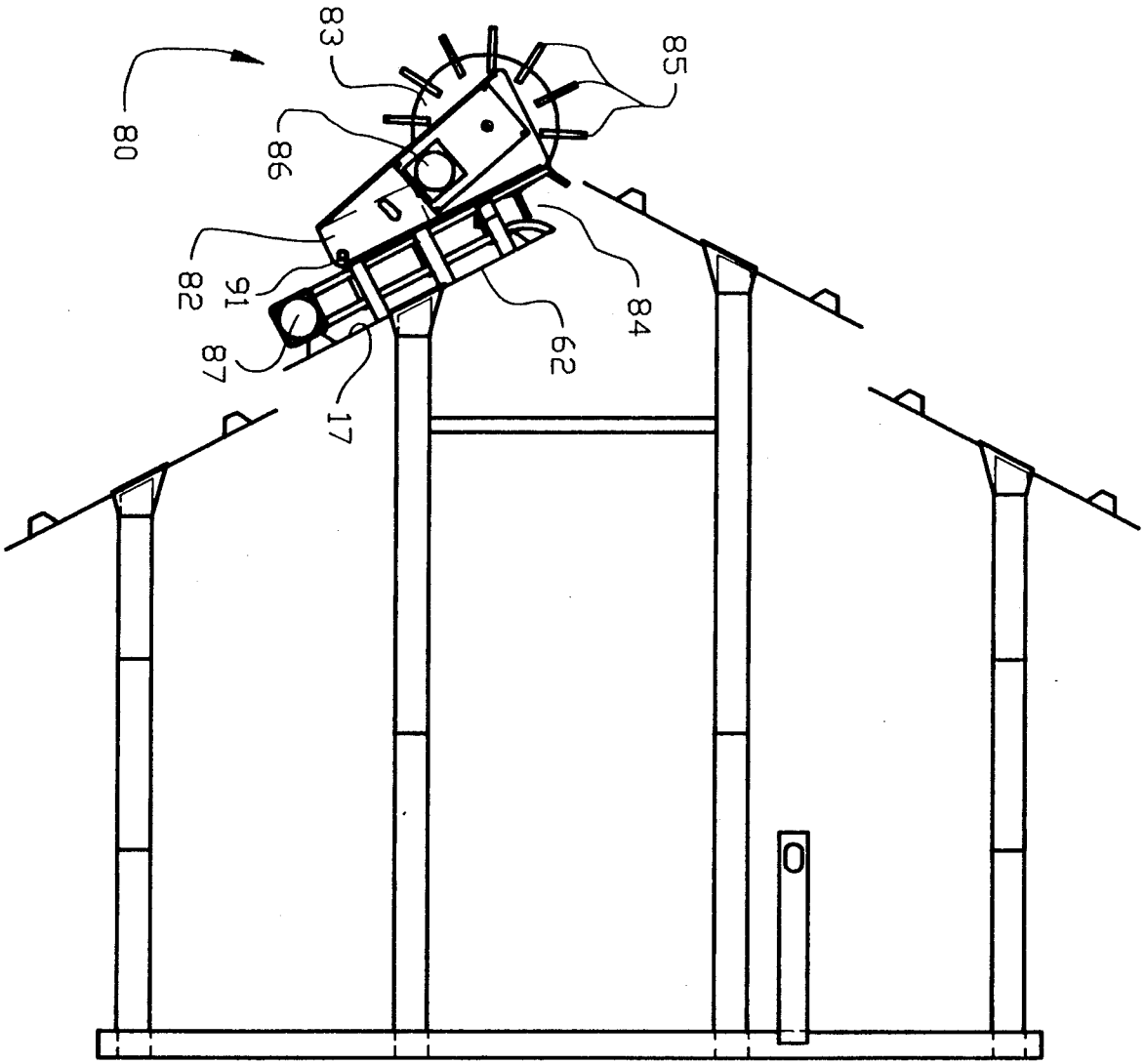
FIG. 7B is a top view of a portion of the second embodiment showing the rake assembly and the horizontal wheel assembly.
Figure 7C:
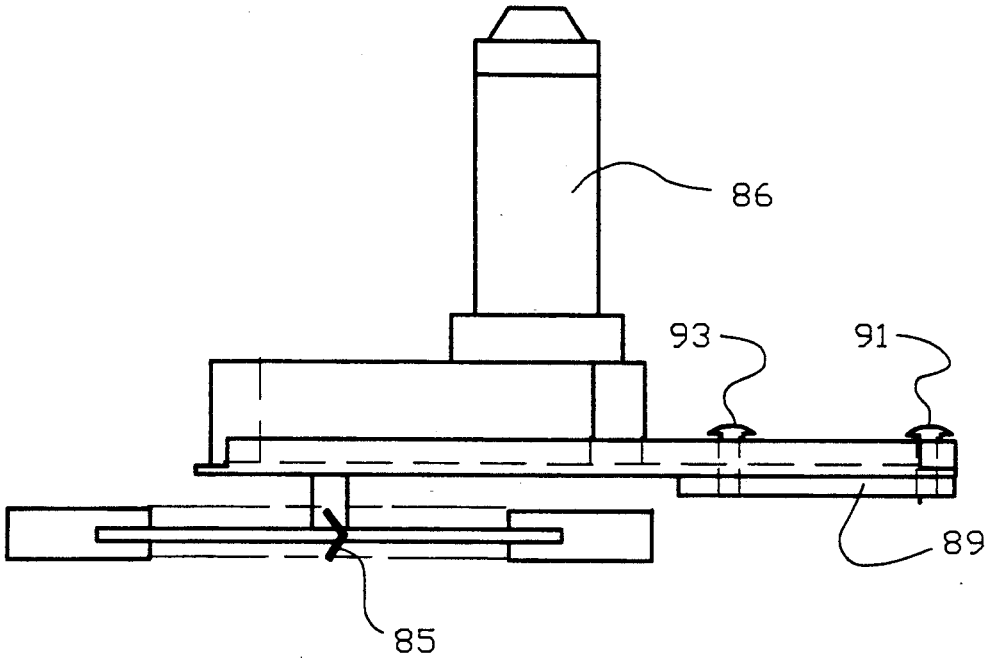
FIG. 7C is a side view of the horizontal wheel assembly.
Figure 7D:
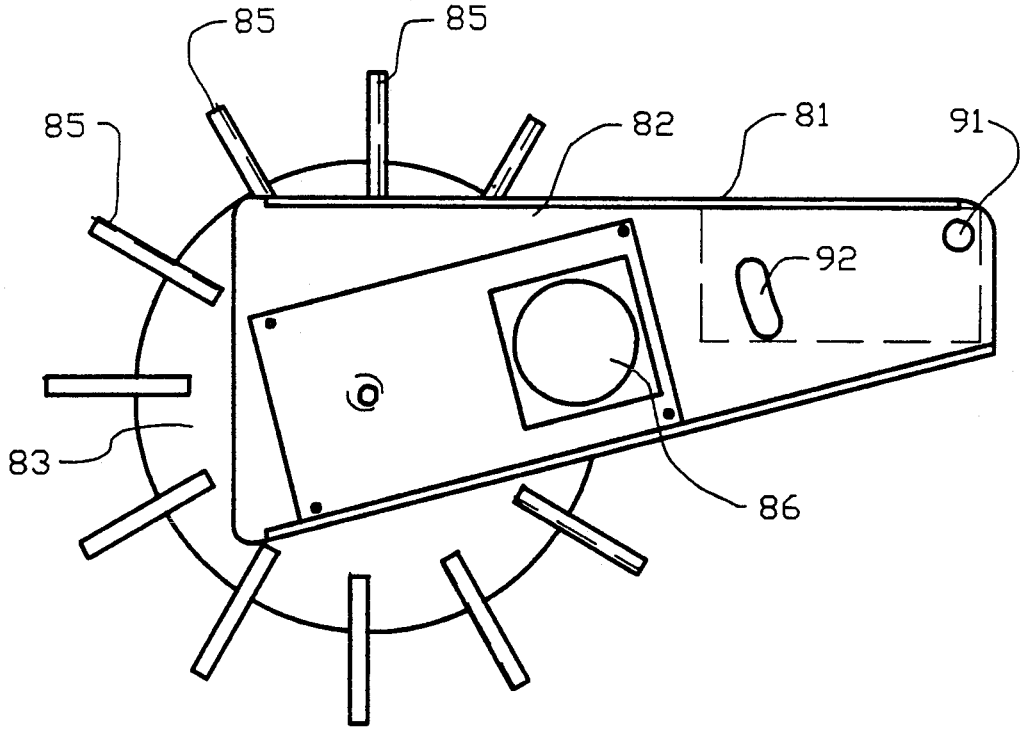
FIG. 7D is a top view of the horizontal wheel assembly.
Figure 7E:
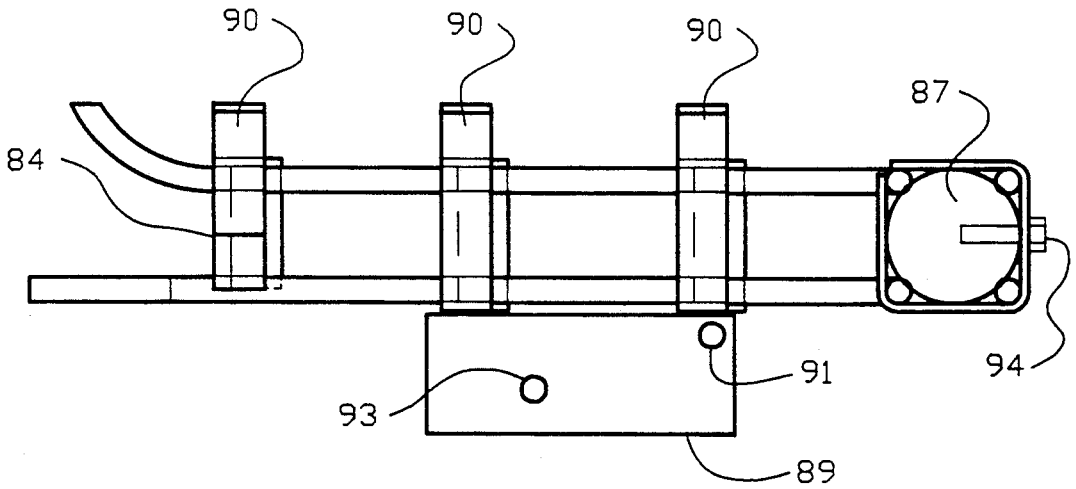
FIG. 7E is a top view of the pickup chute and the ascending tube.
Figure 7F:
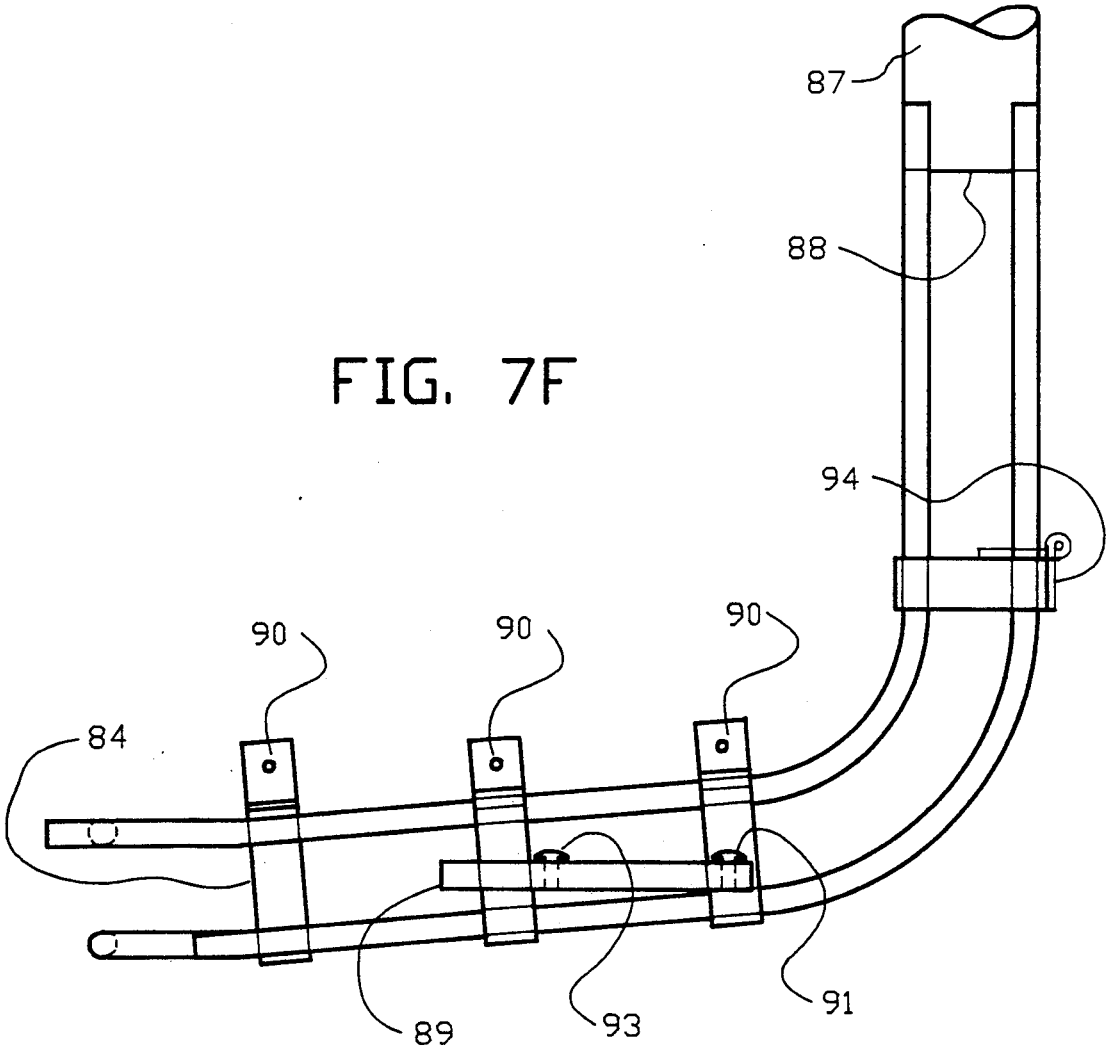
FIG. 7F is a side view of the pickup chute and the ascending tube.

As shown in FIG. 1, and in greater detail in FIGS. 6A and 6B, the vertical wheel assembly 70 comprises a vertical wheel support structure 71 mounted on a pivot bracket 35 on the rear end 16 of the frame 20, and a vertical wheel 72 mounted vertically on the vertical wheel support structure 71 so as to contact the ground. A coil spring bracket 33 is also mounted on the rear end 16 of the frame 20. A coil spring 37 is mounted connecting the coil spring bracket 33 and the vertical wheel support structure 71. A slot 73 is located in the perimeter of the vertical wheel 72, and is lined with a resilient lining 74 comprising foam rubber or other like resilient material.

Figure 8:
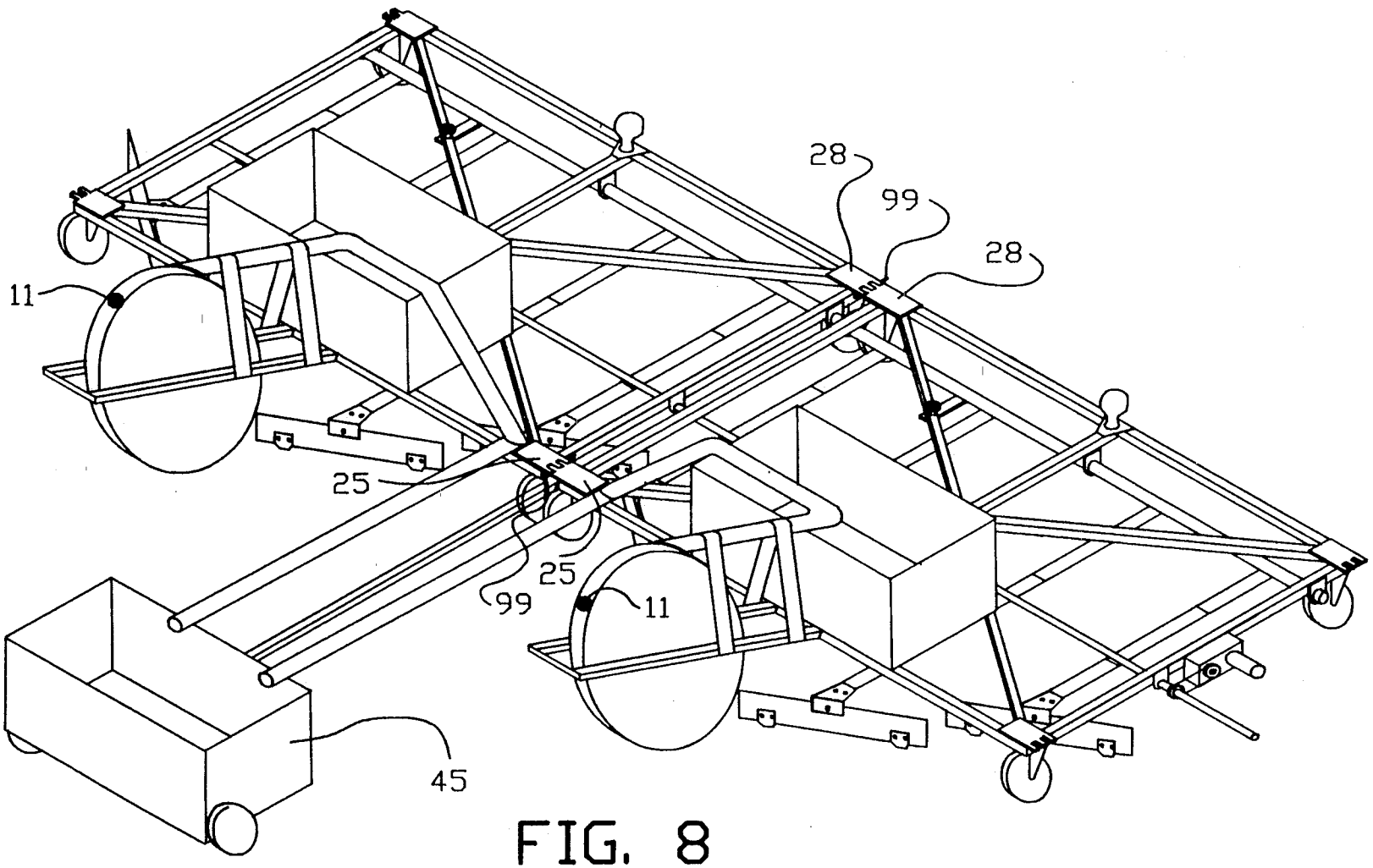
FIG. 8 is an isometric view of two ball retrieving apparatuses affixed together in a side-by-side fashion.

A descending tube 75, having an internal diameter greater than the diameter of the ball 11, is mounted on the vertical wheel support structure 71, and extends from a descending tube intake aperture 76, located adjacent to the slot 73 in the perimeter of the vertical wheel 72, to a descending tube outflow aperture 77 positioned vertically above the container 45. The descending tube intake aperture 76 is positioned at a greater vertical distance from the container 45 than is the descending tube outflow aperture 77. Ball dislodging means shown as a finger 78 is mounted on the descending tube 75, protruding through the descending tube aperture 76 into the slot 73 in the vertical wheel 72. The container 45 may be mounted on the frame as shown in this embodiment, or may be mounted on a separate vehicle as shown in FIG. 8.

FIGS. 7A–F illustrate a second embodiment of the retrieval apparatus 10A wherein the ball catching means is shown as a horizontal wheel assembly 80. The horizontal wheel assembly 80 comprises a pickup chute 84 mounted on a back side 17 of one of the plurality of rake heads 62 by a plurality of chute brackets 90. A shelf bracket 89 is attached to the pickup chute 84 with a hinged mounting plate 82 being attached to the shelf bracket 89 by a mounting screw 91. A spring (not shown) holds the hinged mounting plate 82 adjacent to the pickup chute 84. When an excess force is applied to a horizontal wheel 83, such as by a ball being jammed in the pickup chute 84, the hinged mounting plate 82 is allowed to pivot around the mounting screw 91 within the restriction set by a second screw 93 and a mounting plate slot 92. A power source shown as an electric motor 86 is mounted on the hinged mounting plate 82, and a horizontal wheel 83 mounted horizontally on an output shaft (not shown) of the electric motor 86. A plurality of paddles 85 are attached to the perimeter of the horizontal wheel 83. Alternatively, the power source may comprise a gear train (not shown) and a driving wheel (not shown) capable of transmitting rotational energy from the wheel rolling on the ground to the horizontal wheel 83. A one-way gate 94 is also mounted on the pickup chute 84.

An ascending tube 87, having an internal diameter greater than the diameter of the ball 11, is mounted on the pickup chute 84, and leads from an ascending tube intake aperture 88 adjacent to the pickup chute 84 to an ascending tube outflow aperture 89 positioned vertically above the container 45.

Alternatively, the entire horizontal wheel assembly 80 described above may be mounted on the rear side 16 of the frame 20, rather than on one of the plurality of rake heads 62, and further may be alternatively mounted in a vertical rather than horizontal plane.

The above description of the structure of the apparatus 10, as shown in FIGS. 1–7, is now utilized for the following description of the of operation of the apparatus 10. The function of the apparatus 10 is to transport balls 11 scattered on the surface of the ground into the container 45 in an efficient, reliable and inexpensive manner. The frame 20 is constructed of beams which are readily available, inexpensive, and easy to assembly. The plurality of gusset plates 24 provide added structural strength. Through this configuration, the frame 20 provides strong, yet simple, support for the apparatus 10.

FIG. 1 depicts the method of propulsion of the apparatus 10. The tractor 40 is connected to a pull/push bar 42, which in turn is attached to the hitch 26 mounted on the frame 20. The tractor 40 is driven over ground upon which the balls 11 are scattered, pulling the apparatus 10 behind. The push/pull bar can similarly be used for pushing, rather than pulling, the apparatus 10. Other connecting means which are flexible such as cables or ropes can also be easily used to pull the apparatus 10. The swivels 28 upon which the wheels 29 are mounted allow the apparatus 10 to turn easily and thereby follow the tractor 40 during direction changes.

The function of the rake assembly 50 is to prepare the balls 11 lying on the surface of the ground to be picked by the vertical wheel 72. As the apparatus 10 is propelled over the ground, the plurality of rakes heads 62 slide over the surface thereby contacting balls 11 over which the apparatus 10 is passing. The plurality of rake heads 62 are positioned at such an angle relative to the direction of forward motion of the apparatus 10 that stationary balls 11 on the ground which are contacted by the moving plurality of rake heads 62 are caused to move toward and into the path of the oncoming vertical wheel 72. Each of the plurality of rake heads 62 is free to tilt within each of the plurality of rake head brackets 57 about the axis of the rake head mounting pin 58. This assists each of the plurality of rake heads 62 in maintaining ground contact.

The plurality of adjustable springs 53 provides a spring tension against the plurality of rake heads 62 to assist gravity in maintaining ground contact of the plurality of rake heads 62. The tension is adjustable, and may be increased by rotating the adjustable locking screw 27 in a clockwise direction. When the tension lever 56 mounted on the axle 52, and in contact with the adjustable locking screw 27 is depressed, the axle 52 turns and the spring tension increases on the plurality of adjustable springs 53 which are mounted on the axle 52. This increased spring tension is thus transmitted to the plurality of rake heads 62 which are mounted on the plurality of adjustable springs 53, thereby increasing the force with which the plurality of rake heads 62 are held against the ground. In a similar fashion, the tension is released by rotating the tension lever 56 in a counterclockwise direction. In a more permanent fashion, the spring tension can also be changed individually on each of the plurality of adjustable springs 53 by adjusting the mounting with the axle 52.

This adjustment allows each of the plurality of rake heads 62 attached to each of the plurality of adjustable springs 53 to slide lightly over the surface of the ground under light pressure or to dig below the surface under high pressure. This gives the retrieval apparatus 10 the flexibility to be adjusted for varying terrain conditions, including ground that is soft or hard, smooth or rough, or level or sloped, and grass that is tall or short, thick or thin, wet or dry. This flexibility results in greater efficiency due to a higher percentage of balls captured on each pass.

As shown in FIG. 1 and FIGS. 2A–C, the disengagement assembly 30 is used to lift and lower the plurality of rake heads 62 relative to the ground. The rotational energy of the motor 32 is transmitted to the disengagement axle 34 through the motor-axle linkage 36. As the disengagement axle 34 rotates, the rotational energy is converted to vertical energy through the axle-rake linkage 38. This caused each of the plurality of adjustable springs 53 to be raised, thereby causing each of the plurality of rake heads attached thereto to be lifted from the ground. With an assist from gravity, each of the plurality of rake heads can similarly be lowered to the ground. For increased simplicity, the crank (not shown) can be used in place of the motor 32. Additionally, these lifting and lowering functions can also be performed by the tension lever 56 in conjunction with the adjustable locking screw 27. This disengagement feature further increases the efficiency of the apparatus 10 by allowing an operator to lift the plurality of rake heads 62 from the surface when passing over ground which the operator does not desire to sweep, such as when traveling to a different location, or over roads or sidewalks. This feature also permits the operator to operate in a reverse direction of motion without having to first disconnect the apparatus 10 from the tractor 40 and manually push the apparatus 10.

Since each of the plurality of rake heads 62 is removably mounted on the rake head bracket 57 by the rake head mounting pin 58, various types of rake heads can be easily attached and removed depending upon the type of terrain to be covered. Each of the plurality of rake heads 62 shown in FIGS. 3F and 3G, comprising the ground end 63 upon which the plurality of plates 64 which are mounted, have been found to be effective under various conditions. Similarly, each of the plurality of rake heads 62 shown in FIGS. 4A–D, comprising the plurality of tines 65, can be easily substituted when conditions so warrant. Other types of rake heads can also be utilized. This flexibility further increases the ability of the operator to operate efficiently under varying conditions.

As shown in FIG. 1 and FIGS. 6A–6B, the function of the vertical wheel assembly 70 is to pick up the balls 11 from the surface of the ground, and to transport them to the container 45. As the tractor 40 propels the apparatus 10 over the ground, the vertical wheel assembly 70 pivots about the pivot bracket 35 and the vertical wheel 72 rotates as a result of friction with the ground. This ground contact is assisted by the coil spring 37 applying force between the coil spring bracket 33 mounted on the frame 20 and the vertical wheel support structure 71. The balls 11 hit the plurality of rake heads 62, and are directed into the path of the slot 25 in the perimeter of the vertical wheel 72. The vertical wheel 72 and slot 73 then roll over the balls 11 causing the balls 11 to be resiliently held by the resilient lining 74 of the slot 73.

As the vertical wheel 72 continues to rotate, the balls 11 are carried up and into contact with the finger 78. The finger 78 dislodges the ball 11 from the resilient lining 74 in the slot 73. The balls 11 then enter the descending tube intake aperture 76, and roll downward through the descending tube 75. The balls 11 leave the descending tube 75 through the descending tube outflow aperture 77 and drop into the container 45. The balls 11 are then stored in the container 45 for subsequent removal. By incorporating a single descending tube 75, this design allows the flexibility to utilize containers of various shapes and sizes for easy removal and carriage from the apparatus 10. The container 45 is shown in this embodiment as box-shaped and mounted on the rear side 16 of the frame 20, but may easily be any shape and mounted along side or behind the apparatus 10, or even on a separate wheeled vehicle entirely.

Instead of requiring the ball catching means to be as wide as the swath to be covered, as in the prior art, the vertical wheel 72 of the present invention is very narrow, only slightly wider than the diameter of the ball 11. However, the swath covered is magnified many-fold by the plurality of rake heads 62 directing the encountered balls toward the slot 73 in the vertical wheel 72. Also, as shown in FIG. 8, the plurality of brackets 25 mounted on the right side 12R and the left side 12L of the frame 20 allow for the attachment of a plurality of apparatuses 10 in a side-by-side fashion. This attachment may be quickly and easily made or disconnected by the insertion of one of a plurality of hinge pins 99 through each of the brackets 25. Due to the rigidity of the frame 10, the plurality of apparatuses 10 may be propelled from a single point connection. This is contrasted to the prior art in which each apparatus must be individually propelled. This allows for an even wider swath of ground to be swept for balls 11 on each pass. As such, the operator need make fewer passes to cover the same surface area, thus further increasing efficiency. In addition, the diameter of the vertical wheel 72 is sufficiently large to allow high speed operation, which further adds to efficiency.

In another embodiment, shown in FIGS. 7A–F, the ball catching means is shown as the horizontal wheel assembly 80. The horizontal wheel 83 is mounted preferably in the horizontal plane in close proximity to the ground. The pickup chute 84 is mounted in contact with the ground. As the tractor 40 propels the apparatus 10A over the ground, the horizontal wheel 83 is rotated clockwise by the electric motor 86. The balls 11 hit the rake heads and are directed into the path of the paddles 85. As the horizontal wheel 83 rotates, the paddles 85 mounted thereon sweep the balls 11 into the pickup chute 84.

The rotating horizontal wheel 83 and the plurality of paddles 85 mounted thereon which sweep the balls 11 into the pickup chute 84 continue to apply force to the balls 11 once inside the pickup chute 84, and force the balls 11 into the ascending tube intake aperture 88 and up the ascending tube 87. Once the ascending tube 87 is full of balls 11, any additional ball 11 entering the ascending tube 87 will force the uppermost ball 11 out of the ascending tube outflow aperture 89 thereby causing the ball 11 to drop into the container 45.

This embodiment also incorporates features which prevent jamming, and limit the collection of unwanted debris, thereby further increasing efficiency. The pickup chute 84 has openings on all sides thereby allowing small pieces of debris swept in by the plurality of paddles 85 to fall away from the pickup chute 84. If a large piece of debris is encountered, the force of the paddle 85 against the debris causes the hinged mounting plate 82, electric motor 86, horizontal wheel 83 and paddles 85 to all swing away from the pickup chute 84. Furthermore, the electric motor 86 incorporates an automatic momentary reverse feature which momentarily reverses the direction of rotation of the electric motor 86 and paddles 85 when a jam is detected. These features allow the apparatus 10 to automatically clear the large piece of debris from the pickup chute 84. During this clearing operation, the one-way gate 94 prevents the balls already in the ascending tube 87 from dropping back out.

In summary, the apparatus 10 described above allows for the collection of balls 11 from the ground in an efficient, reliable and inexpensive manner. The features incorporated in the design and the flexibility available in the operation of the apparatus 10 under different conditions and allow for efficient collection. The design is relatively simple, resulting in greater reliability. The materials are inexpensive to purchase and easy to acquire and assemble resulting in lower cost. The present invention offers an improved apparatus and method for retrieving balls 11 over the prior art devices.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved apparatus for retrieving balls from the ground and depositing the balls in a container, comprising:

a frame capable of being moved over the ground;

motive means for moving said frame over the ground;

ball catching means mounted on said frame for picking up the balls from the ground and for transporting the balls to the container;

a rake assembly mounted on said frame for directing the balls toward said ball catching means;

said rake assembly comprising a plurality of rake heads;

a plurality of spring means mounted on said frame for individually mounting said plurality of rake heads relative to said frame with said ball catching means being disposed between said plurality of rake heads;

said plurality of spring means individually biasing each of said plurality of rake heads in contact with the ground for sliding over a surface of the ground and directing the balls toward said ball catching means irrespective of variations in the contour of the ground; and each of said plurality of rake heads being positioned at an angle with a direction of forward motion of said frame such that a ball which contacts one of said plurality of rake heads is transferred to an adjacent one of said plurality of rake heads toward said ball catching means.

2. An improved apparatus for retrieving balls as set forth in claim 1, wherein said ball catching means comprises a ball catching wheel.

3. An improved apparatus for retrieving balls as set forth in claim 1, comprising a plurality of brackets mounted on said frame for attaching a plurality of frames together.

4. An improved apparatus for retrieving balls as set forth in claim 1, wherein said motive means comprises a motor vehicle independent of the apparatus; and connecting means for attaching said motive means to said frame.

5. An improved apparatus for retrieving balls as set forth in claim 1, including spring adjustment means for increasing and decreasing said spring tension of said plurality of spring means for holding said plurality of rake heads against the ground.

6. An improved apparatus for retrieving balls as set forth in claim 1, wherein each of said plurality of rake heads has a ground end contacting the ground which is flat and bent rearward for sliding over the surface of the ground under light pressure and for digging below the surface of the ground under high pressure.

7. An improved apparatus for retrieving balls as set forth in claim 1, wherein each of said plurality of rake heads is removably mounted on said frame.

8. An improved apparatus for retrieving balls from the ground and depositing the balls in a container, comprising:

a frame capable of being moved over the ground;

motive means for moving said frame over the ground;

ball catching means mounted on said frame for picking up the balls from the ground and for transporting the balls to the container;

a rake assembly mounted on said frame for directing the balls toward said ball catching means;

said rake assembly comprising a plurality of rake means including a first and a second outer rake head and a first and a second inner rake head;

a plurality of spring means mounted on said frame for individually mounting each of said plurality of rake heads relative to said frame with said ball catching means being disposed between said first and second inner rake heads;

said plurality of spring means individually biasing each of said plurality of rake heads in contact with the ground for sliding over a surface of the ground and directing the balls toward said ball catching means irrespective of variations in the contour of the ground; and each of said plurality of rake heads being positioned at an angle with a direction of forward motion of said frame such that a ball which contacts one of said first and second outer rake heads is transferred to one of said inner rake heads to be received by said ball catching means.

9. An improved apparatus for retrieving balls and depositing the balls in a container, comprising:

a frame capable of being moved over the ground;

motive means for moving said frame over the ground;

a vertical wheel mounted on said frame for picking up the balls from the ground and for transporting the balls to the container;

said vertical wheel rotating in a vertical plane and being parallel to a direction of travel of said frame;

a slot located in a perimeter of said vertical wheel with said slot being lined with a resilient lining for picking up the balls from the ground in said slot and for holding the balls in said slot while said vertical wheel transports the balls to the container;

a plurality of rake heads including a first and a second outer rake head and a first and a second inner rake head;

a plurality of spring means mounted on said frame for individually mounting each of said plurality of rake heads relative to said frame with said vertical wheel being disposed between said first and second inner rake heads;

said plurality of spring means individually biasing each of said plurality of rake heads in contact with the ground for sliding over a surface of the ground and directing the balls toward said vertical wheel irrespective of variations in the contour of the ground; and each of said plurality of rake heads being positioned at an angle with the direction of motion of said frame such that a ball which contacts one of said first and second outer rake heads is transferred to one of said inner rake heads to be received by said vertical wheel.

10. An improved apparatus for retrieving balls as set forth in claim 9, including spring adjustment means for adjusting said spring tension on said plurality of adjustable springs holding said plurality of rake heads against the ground.

11. An improved apparatus for retrieving balls as set forth in claim 9, wherein said plurality of adjustable springs are mounted on an axle for applying a spring tension against each of said plurality of rake heads to hold each of said plurality rake heads against the ground; and a spring adjustment means comprising a tension lever for adjusting said spring tension on said plurality of adjustable springs holding said plurality of rake heads against the ground.

* * * * *